United States Patent [19]

Sartor

[11] Patent Number: 4,785,555

[45] Date of Patent: Nov. 22, 1988

[54] FOOT SECURING DEVICE, PARTICULARLY FOR SKI BOOTS

[75] Inventor: Mariano Sartor, Montebelluna, Italy

[73] Assignee: Nordica S.p.A., Montebelluna TV, Italy

[21] Appl. No.: 88,635

[22] Filed: Aug. 24, 1987

[30] Foreign Application Priority Data

Sep. 4, 1986 [IT] Italy ..... 82752 A/86

[51] Int. Cl.[4] ..... A43B 5/04; A43C 11/00

[52] U.S. Cl. ..... 36/119; 36/50

[58] Field of Search ..... 36/117–121, 36/50, 58.5

[56] References Cited

U.S. PATENT DOCUMENTS

| | | | |
|---|---|---|---|
| 4,196,530 | 4/1980 | Delert | 36/119 |
| 4,449,274 | 5/1984 | Balbinot | 36/117 X |
| 4,561,196 | 12/1985 | Petrini et al. | 36/118 |
| 4,593,483 | 6/1986 | Paris | 36/119 |
| 4,620,379 | 11/1986 | Sartor | 36/119 |
| 4,700,496 | 10/1987 | Pozzobon | 36/117 |

FOREIGN PATENT DOCUMENTS

| | | | |
|---|---|---|---|
| 074513 | 3/1983 | European Pat. Off. | 36/121 |
| 226857 | 1/1987 | European Pat. Off. | 36/119 |

*Primary Examiner*—James Kee Chi

*Attorney, Agent, or Firm*—Guido Modiano; Albert Josif

[57] ABSTRACT

The foot securing device comprises a cable which extends partially inside a boot and is guided by means of guide elements to act on a foot presser. The boot has a front quarter connected to a shell, and an upper front quarter connected to an upper portion of the front quarter. The cable extends over the upper front quarter so as to act on the presser according to the movement of the upper front quarter with respect to the quarter.

14 Claims, 3 Drawing Sheets

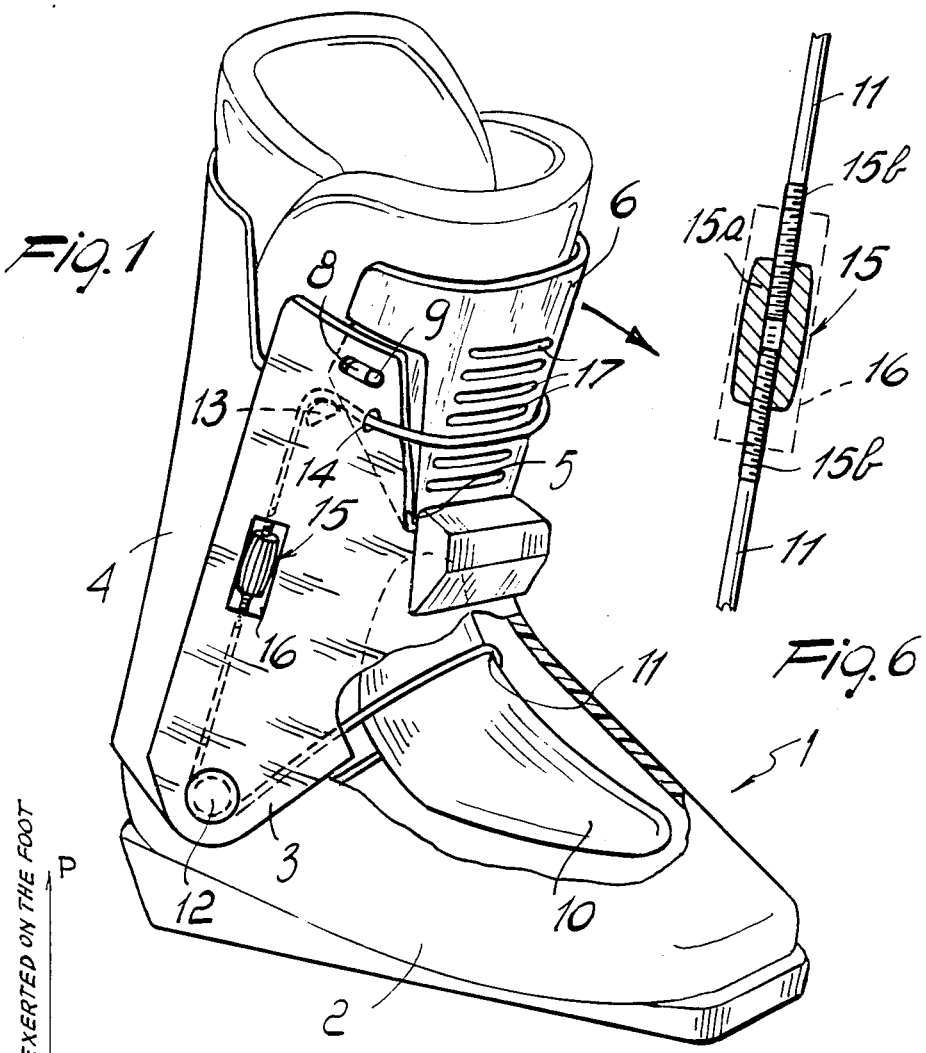
Fig. 1
1
2
3
4
5
6
8
9
10
11
12
13
14
15
16
17
Fig. 6
11
15b
15a
15
16
15b
11
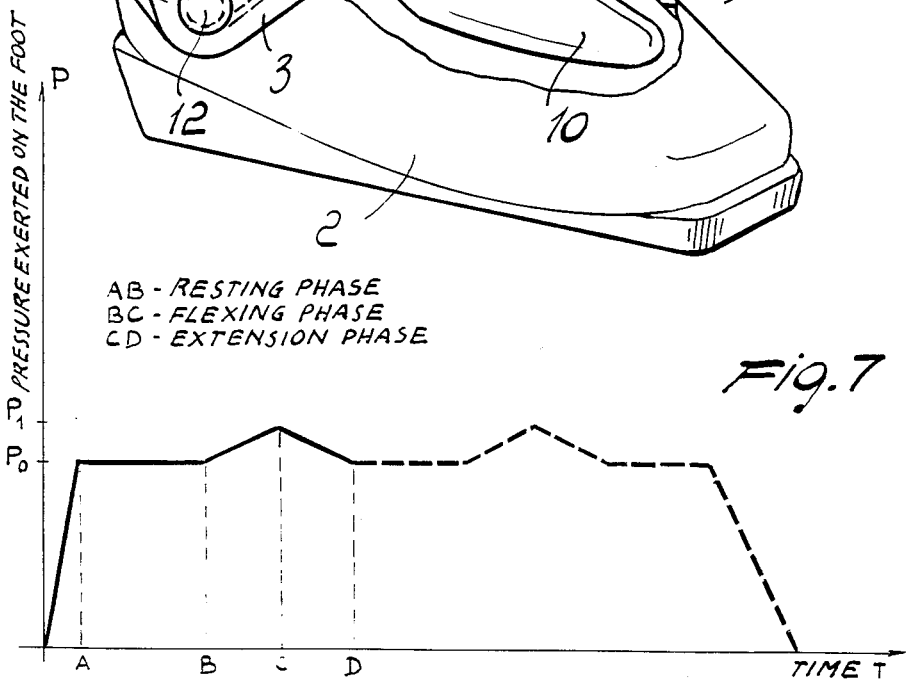
Fig. 7
P PRESSURE EXERTED ON THE FOOT
P1
P0
AB - RESTING PHASE
BC - FLEXING PHASE
CD - EXTENSION PHASE
A
B
C
D
TIME T

FOOT SECURING DEVICE, PARTICULARLY FOR SKI BOOTS

BACKGROUND OF THE INVENTION

The present invention relates to a foot securing device, particularly for ski boots.

As is known, a problem found in the manufacture of ski boots is that of securing the foot, especially during the flexing phase when the heel tends to rise, not ensuring a precise transmission of the stresses from the foot to the ski.

Several securing devices have been hitherto adopted, particularly of the type wherein a cable acts on a plate which presses on the foot.

Such devices are known, for example, from U.S. Pat. No. 4,449,274 and from French Pat. No. 2536965 filed on Feb. 12, 1982.

In the solutions hitherto adopted, the cable often traces tortuous paths which complicte the construction of the boot, or there are complicated and expensive adjustment mechanisms which furthermore increase the overall weight of the boot.

The same problems also arise in systems with a mechanical pressor, for example of the type wherein one or more screws act directly on a pressure plate.

Some known systems provide a good adjustment of the pressure on the foot, even if by means of complicated devices, but this pressure is often constant both during the flexing phase and during the extension and resting phase.

In order to firmly secure the foot during the flexing phase, a pressure much greater than that necessary during the rest and/or extension phase is required.

In conventional devices, it often occurs that the foot is subject to an excessive pressure during the extension and rest phases, or, vice versa, it is not firmly secured during the flexing phase.

SUMMARY OF THE INVENTION

The aim of the present invention is therefore to eliminate the disadvantages described above in known types by providing a device which exerts a pressure on the foot which is adapted to the variable conditions of use of the boot.

Within the scope of the aim described above, a particular object of the invention is to provide a device which is simple to use and easy to manufacture, and therefore advantageous from an economic point of view.

The aim described above, as well as the objects mentioned and others which will become apparent hereinafter, are achieved by a foot securing device, particularly for ski boots having a front quarter and a rear quarter associated with a shell, comprising:

a movable element connected to said front quarter and movable with respect thereto, at least one foot presser arranged inside said shell, characterized in that it comprises at least one cable connecting said at least one presser to said movable element so that a movement of said movable element with respect to said shell is matched by a movement of said at least one presser.

BRIEF DESCRIPTION OF THE DRAWINGS

Further characteristics and advantages will become apparent from the description of a preferred, but not exclusive, embodiment of a device illustrated only by way of non-limitative example in the accompanying drawings, wherein:

FIG. 1 is a perspective view of a ski boot provided with the device according to the invention;

FIG. 6 is a transverse cross section view of a means for the adjustment of the working length of the cable; and FIG. 7 is a graph showing the pressure exerted on the foot by the presser while skiing.

DESCRIPTION OF THE PREFERRED EMBODIMENTS

Figure 2:
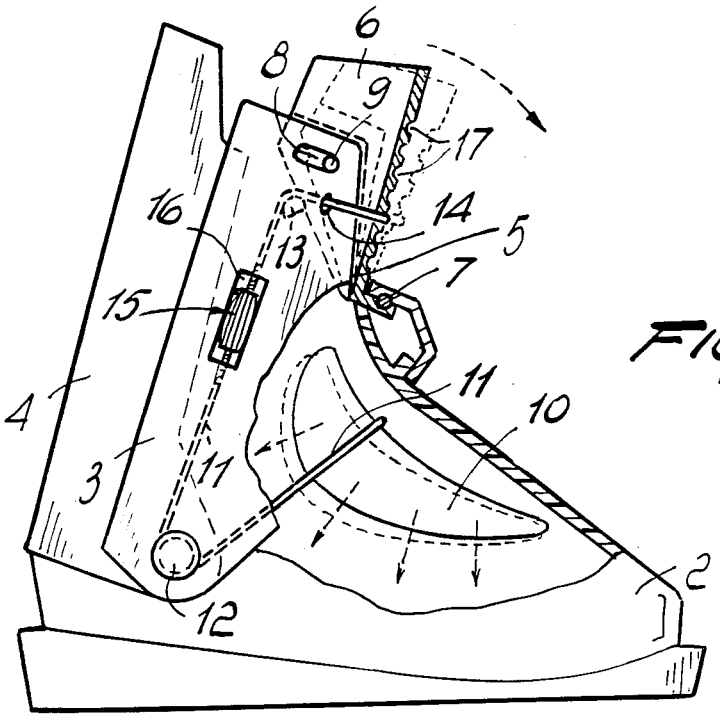
FIG. 2 is a lateral elevation view, in cross section, of a boot with the device applied to a foot instep presser.

With reference to the above described figures, a ski boot 1 comprises a shell 2 whereto are connected, in a per se known manner, a front quarter 3 and a rear quarter 4.

A movable element is arranged in a depressed region 5 of the front upper border of the front quarter, and is composed of a movable element or front upper quarter 6 which is oscillable with respect to the front quarter 3. The upper front quarter 6 can, for example, be pivoted by means of the pivot 7 to the front region of the quarter 3 and has elongated slots 8 engaged by respective pins 9 fixed to the sides of the front quarter. The upper front quarter 5 can be connected to the front quarter 3 even by means of other different systems, for example as described in the U.S. patent application Ser. No. 07/036519, filed by the same Applicant.

With this arrangement, the upper front quarter 6 is oscillable with respect to the front quarter 3 along a transverse axis which passes through the pivot 7.

With reference to FIGS. 1 and 2 the device consists of a pressure plate 10, pivoted in a per se known manner to the shell 2 or freely slideable, arranged inside said shell at the foot instep and preferably outside the inner boot with which ski boots are normally provided.

A cable 11, located inside the boot, acts on the pressure plate 10 and extends above its longitudinal extension.

Said cable 11, which is guided by means of a lower guide element 12 and of an upper guide element 13, extends along the lateral region of the boot and protrudes from the slot 14 proximate to the upper front quarter 6, embracing it on the outer side.

The guide elements 12 and 13 can be constituted by pulleys or similar means fixed to the inside of the boot.

For example, in the figures, the lower guide elements 12 consist of pulleys arranged at pivots for the pivoting of the quarters with respect to the shell; while the upper guide elements 13 each expediently consist of a shaped raised portion provided on the inner surface of the sides of the front quarter 3.

Obviously, there are two pairs of guide elements, since the cable extends on both sides of the boot, only one of said sides being visible in FIG. 2.

The two lower guide elements 12 are preferably arranged downwardly with respect to the pressure plate 10 so that the cable 11, which extends above the plate 10, can act on said plate and press on the foot.

For the correct operation of the device it is important that the guide elements 12 and 13 be positioned so that an inclination of the upper front quarter 6 is matched by an increase in the length of the cable between a point defined on the outside of the upper front quarter and the guide elements 12 or 13.

Said point can consist, for example, of a notch 17 provided transversely on the front outer surface of the upper front quarter 6 which accommodates the external portion of the cable 11.

For the adjustment of the useful length of the cable 11, an adjustment element 15 for the adjustment of the working length of said cable is provided, and in this case is advantageously located on a side of the front quarter 3. Said element 15 follows the excursion of the cable during the flexing phase and is therefore movable with respect to the quarter.

The element 15 can be furthermore provided by known means, such as for example a cylinder **15*a* with counterposed threads which engage threaded ends 15*b* of the cable 11, slideable in a slot 16 provided on the front quarter so that the cylinder 15*a*** is manually rotatable from the outside.

The adjustment element 15, besides performing a fine adjustment of the tension of the cable 11, allows a sufficient slackening of said cable to faciliate the operation of putting on the boot.

The position of the cable 11 on the outer side of the upper front quarter 6, can be advantageously ensured by means of a series of notches 17 provided transversely with respect to said upper front quarter.

Said plurality of notches 17 allow an approximate adjustment of the tension of the cable.

Figure 3:
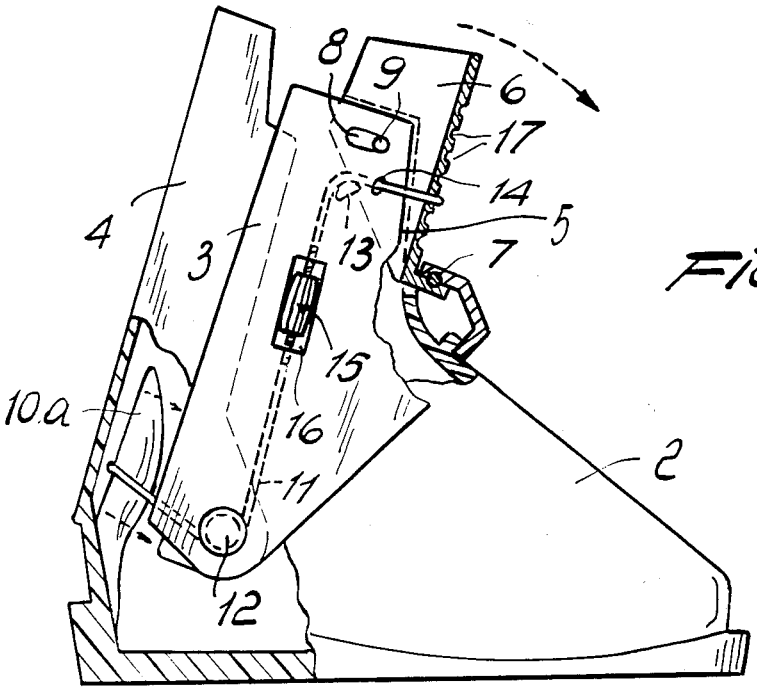
FIG. 3 is a lateral elevation view, in cross section, of a boot with the device applied to a heel presser.

With reference to FIG. 3, the pressure plate **10*a*** can be arranged at the heel of the foot by obtaining it, for example, out of the inner shoe or out of the shell of said boot.

The structure of the device, with the plate **10*a* at the heel, is substantially similar to the one described above, and the operation is similar to that of the embodiment illustrated in FIGS. 1 and 2** except that the pressure is exerted on the heel.

Figure 4:
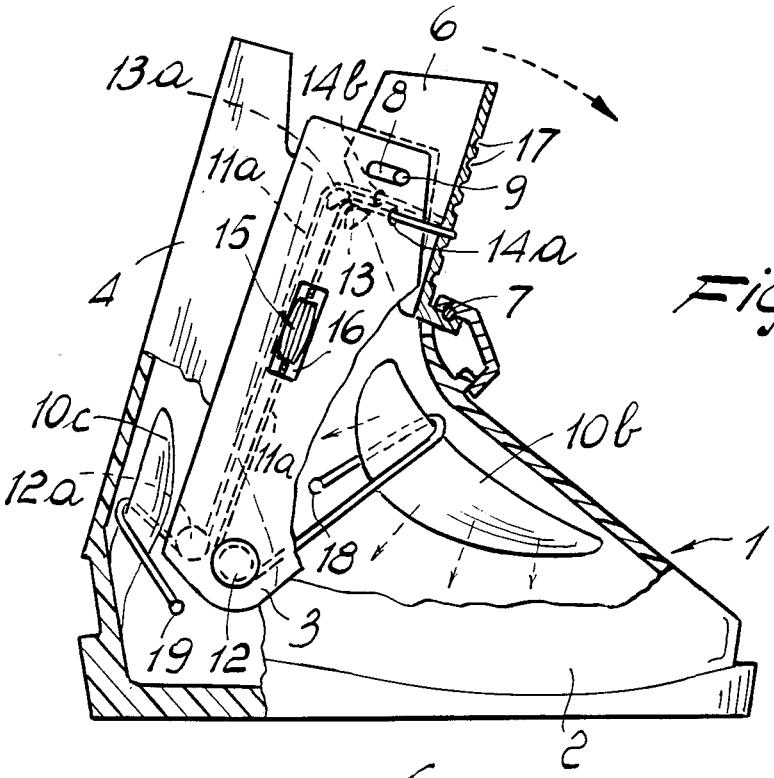
FIG. 4 is a lateral elevation view, in cross section, of a boot with the device applied simultaneously to a foot instep presser and to a heel presser.

With reference to FIG. 4, the device is characterized in that it compares two pressure plates which act simultaneously on the foot.

A pressure plate **10*b* is located at the foot instep, pivoted by the shell or freely slideable, while a pressure plate 10*c*** is located at the heel and can expediently be defined by the inner shoe or by the shell of the boot.

The cable **11*a* is advantageously fixed at one end, for example by means of an eyelet, to a first point 18 located inside the shell 2 and arranged downwardly and laterally with respect to the region of location of said pressure plate 10*b*** and extends transversely above said plate with respect to its longitudinal extension.

At the other end, the cable **11*a* is fixed, in a similar manner, to a second point 19 arranged inside the shell and located frontally and laterally with respect to the region of location of said pressure plate 10*c***.

Similarly to the above mentioned devices, the cable **11*a* extends along the sides of the quarter of the boot by means of the lower guide element 12 and the upper guide element 13 on one side and by means of the lower guide element 12*a* and the upper guide element 13*a* on the other side, and protrudes out of the slots 14*a* and 14*b***, arranged symmetrically proximate to the front quarter, extending on the outer side of said quarter.

An adjustment element 15 for the adjustment of the working length of the cable is advantageously arranged in the lateral region of the boot for permitting the fine adjustment of the tension of the cable.

The operation of each of the devices described above is substantially similar: during the leg flexing phase there is an increase in the distance between the upper guide elements 13 and the point 14 defined on the upper front quarter where the cable 11 is accommodated.

This increase results in an increase in the pressure on the foot by means of a further tensioning of said cable.

During the extension phase, the initial pressure is restored by virtue of the elastic return of the cable. In other words, the pressure on the foot depends on the inclination of the upper front quarter with respect to the front quarter and therefore on the inclination of the leg.

This is correct from a technical point of view, since during flexing a greater securing of the foot is required to prevent the rise of the heel, thus ensuring a precise transmission of the stresses from the foot to the ski.

The graph of FIG. 7 shows the pressure on the foot during the flexing, extension and rest phases.

Figure 5:
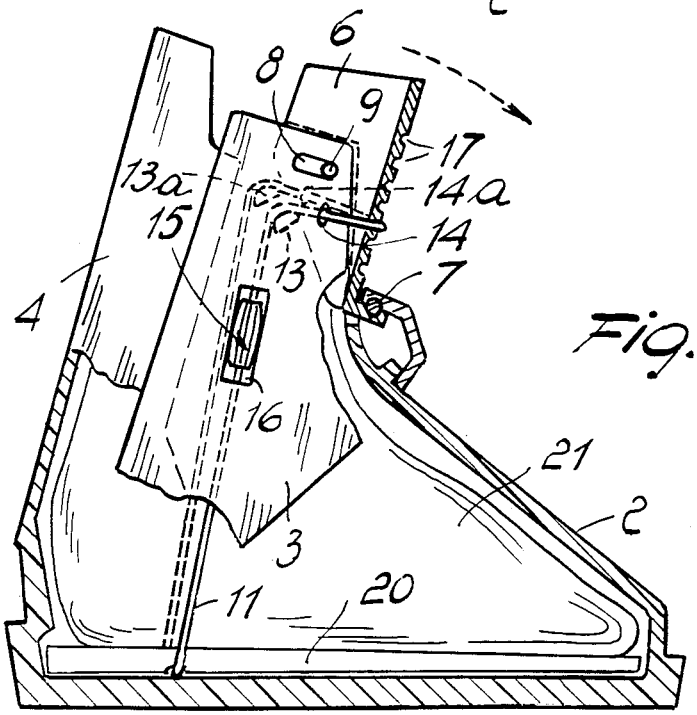
FIG. 5 is a sectional elevation view of a boot with the device applied to a presser consisting of an insole.

With reference to FIG. 5, the device, according to another aspect of the invention, is characterized in that the cable 11 is caused to pass, inside the boot 1, beneath an insole 20 which can be interposed between the base of the shell 2 and the inner shoe 21, the insole 20 being movable and acting on the foot as a presser.

In the leg flexing phase, once the cable is positioned on the point 14 and the element 15 is adjusted, the insole 20 is caused to rise, the cable 11 sliding on the upper guide elements **13*a* and 13**.

In practice it has been observed that the device according to the invention fully achieves the intended aim and in particular the fact is stressed that it is simple to use and easy to manufacture.

The materials employed, which are preferably those conventionally used in the manufacture of ski boots, as well as the dimensions and the contingent shapes, may be any according to the specific requirements.

I claim:

1. In a ski boot having a front quarter and a rear quarter pivotally associated with a shell, a foot securing device comprising:

a movable element arranged for abuttment against a front portion of a skier's lower leg;

means for movably mounting said movable element on said front quarter;

at least one presser arranged inside said shell for exerting a clamping action on a skier's foot;

at least one cable for operatively connecting said movable element to said at least one presser;

wherein said means for movably mounting said movable element to said front quarter comprises oscillating means allowing substantially continuous oscillation of said movable element with respect to said front quarter in both forward and backward direction about an oscillation axis extending transversely of said front quarter, said at least one cable extending from a location of said movable element remote from said oscillation axis along a direction at least partially towards said skier's lower leg and extending away from said at least one presser along a direction at least partially towards said skier's foot, whereby said at least one presser is caused to automatically move towards and away from said skier's foot in response to a forward and backward oscillation of said movable element to thereby provide a continuous and proportional variation in said clamping action on said skier's foot upon corresponding increase in flexing of said skier's lower leg during skiing.

2. A device according to claim 1, wherein said movable element comprises a substantially curved plate with a rear concave surface substantially conforming to the front portion of said skier's lower leg and with a front convex surface at least partially protruding from a substantially complementary shaped vane extending from the upper border of said front quarter at least partially downwardly thereof.

3. A device according to claim 1, wherein said oscillation axis is located proximate to the lower end of said movable element adjacent to the lower edge of said movable element adjacent to the lower edge of said complementary shaped vane of said front quarter.

4. A device according to claim 1, wherein said front surface of said movable element is provided with at least one notch for the accomodation of a connecting portion of said at least one cable.

5. A device according to claim 1, wherein said at least one cable is provided with length adjusting means.

6. A device according to claim 1, wherein said length adjusting means comprises a cylindrical body having an axially extending hole provided with counterthreaded ends, said counterthreaded ends engaging with complementary threaded end portions of said at least one cable to provide oppositely directed displacement on said cable end portions on rotation of said cylindical body about its rotation axis.

7. A device according to claim 1, wherein said front quarter has a lateral cavity arranged for rotatably supporting said cylindrical body in an accessible position from the outside.

8. A device according to claim 1, wherein said at least one presser comprises a first presser located inside said shell proximate to the foot instep portion thereof and actuatable by said at least one cable.

9. A device according to claim 1, comprising a second presser located inside said shell proximate to the heel portion thereof and actuatable by said at least one cable.

10. A device according to claim 1, wherein said presser located proximate to said heel portion is solid with an inner shoe or is an inner part of said shell.

11. A device according to claim 1, comprising a first presser located inside said shell proximate to the foot instep thereof and a second presser located inside shell proximate to the heel portion thereof, said first and said second foot presser being both actuatable by said at least one cable.

12. A device according to claim 1, further comprising means for guiding said at least one cable inside said shell so that said at least one cable overrides at least partially said at least one presser from the outer side thereof opposite to the skier's foot.

13. A device according to claim 1, wherein said at least one cable is substantially continuous loop.

14. A device according to claim 1, wherein there is provided a third presser comprising a movable insole interposed between the inner base surface of said shell and an inner shoe, said at least one cable passing beneath said movable insole to force it upwardly against said inner shoe.

* * * * *